US005253667A

United States Patent [19]

Chung

[11] Patent Number: 5,253,667

[45] Date of Patent: Oct. 19, 1993

[54] COLLAPSIBLE TUBULAR FRAME

[76] Inventor: Ching-Pao Chung, No. 120-18, Yu Che, Yu Che Li, Ma Tou Chen, Tainan Hsien, Taiwan

[21] Appl. No.: 31,969

[22] Filed: Mar. 16, 1993

[51] Int. Cl.[5] ..... E04H 15/38

[52] U.S. Cl. ..... 135/103; 135/106; 135/107

[58] Field of Search ..... 135/101, 102, 103, 106, 135/107, 108, 114; 52/67

[56] References Cited

U.S. PATENT DOCUMENTS

| | | | |
|---|---|---|---|
| 2,928,403 | 3/1960 | Hoskins | 135/107 |
| 3,866,619 | 2/1975 | Per Frisk | 135/114 |
| 3,896,831 | 7/1975 | Feldman et al. | 135/103 |
| 3,933,164 | 1/1976 | Ness et al. | 135/103 X |
| 4,063,830 | 12/1977 | Ban | 135/114 X |
| 4,934,396 | 6/1990 | Vitta | 135/107 |
| 5,031,652 | 7/1991 | Lester | 135/108 X |

FOREIGN PATENT DOCUMENTS

| | | | |
|---|---|---|---|
| 1292650 | 6/1961 | France | 52/67 |
| 2507653 | 12/1982 | France | 52/67 |
| 2075567 | 11/1981 | United Kingdom | 52/67 |
| 2121083 | 12/1983 | United Kingdom | 52/67 |

*Primary Examiner*—Carl D. Friedman
*Assistant Examiner*—Lan M. Mai
*Attorney, Agent, or Firm*—Morton J. Rosenberg; David I. Klein

[57] ABSTRACT

A shrinkable tubular frame is composed of a plurality of curved tubes having the same length and curvature but different diameter for shrinking in a largest-diameter curved tube one after another so as to be become very short when being shrunk. Each two curved tubes are locked by a fixing unit when being extended out. A winding unit for winding back a rope extended in the frame so as to pull the other curved tubes, except a left one, to shrink in the left largest-diameter tube after being extended out.

3 Claims, 2 Drawing Sheets

COLLAPSIBLE TUBULAR FRAME

BACKGROUND OF THE INVENTION

Common collapsible frames for tents, sunshades, etc. used nowadays are not so convenient in collapsing them, generally taking time in extending and assembling them.

SUMMARY OF THE INVENTION

This invention has been devised to offer a kind of collapsible tubular frame for tents, sunshades, etc., having a simpler structure than conventional ones for shrinking and extending in a short time and becoming a minimum size as best as possible when shrunk.

The shrinkable tubular frame in this invention is composed of a plurality of curved tubes of the same length and curvature but different diameter so that the curved tubes can be shrunk in a largest-diameter one and finally become very short after all tubes except the largest one are all shrunk in the largest one.

A fixing unit is provided to lock two neighboring curved tubes when extended out and to loosen the two tubes when they are to be shrunk.

A winding unit is provided in a left largest-diameter curved tube to wind a rope adapted to extend from an outer end of the left curved tube to an outer end of the right curved tube when this frame is to be shrunk to pull the other curved tubes except the left largest one to shrink into the left largest one.

A coil spring is provided to extend inside the frame from the outer end of the left largest tube to the outer end of the right smallest tube to assist the tubes to be shrunk by its elasticity.

BRIEF DESCRIPTION OF DRAWINGS

The invention will be better understood by reference to the accompanying drawings, wherein.

DESCRIPTION OF THE PREFERRED EMBODIMENTS

Figures 1, 4:
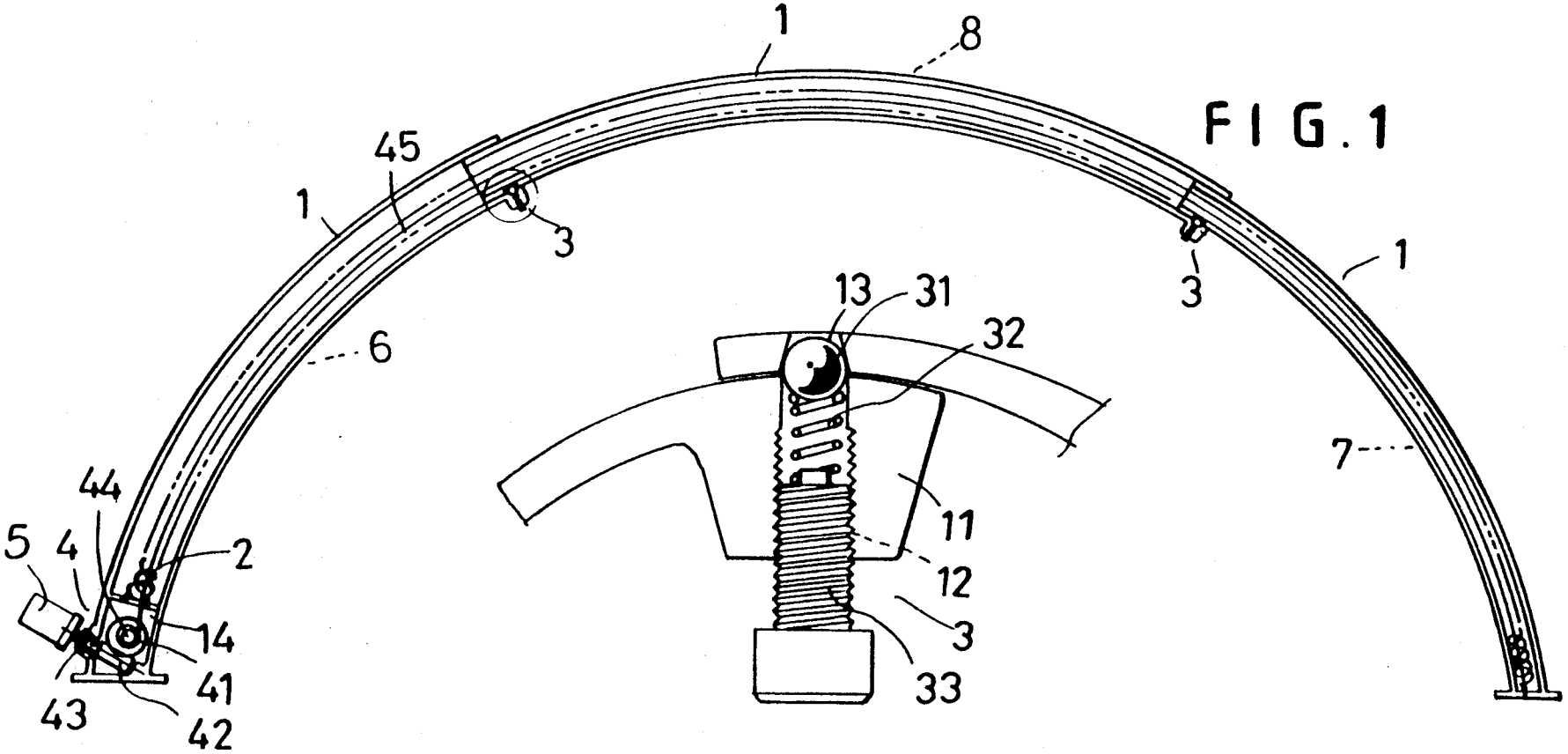
FIG. 1 is a cross-sectional view of a shrinkable tubular frame in the present invention.
Figure 2:
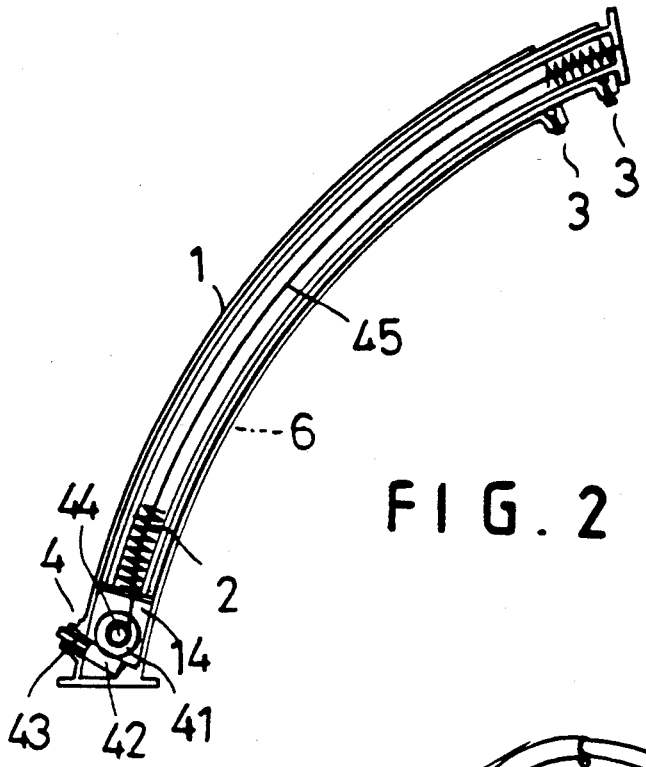
FIG. 2 is a cross-sectional view of the shrinkable tubular frame in a shrunk position in the present invention.

A shrinkable tubular frame in the present invention, as shown in FIG. 1, includes a plurality of hollow curved tubes 1, a plurality of fixing units 3, and a winding unit 4 combined together. For example, it is made up of three tubes 1, a left largest diameter one 6, an intermediate larger-diameter one 8 and a right smallest-diameter one 7, a coil spring 2 extending inside the three tubes from an outer end of the left tube 6 to an outer end of the right tube 7, and two fixing units 3, 3 respectively fixing each two tubes 6 and 8, 8 and 7 together. The three tubes 6, 7, 8, have the same length and curvature but different diameter so that the right smallest-diameter tube 7 can be shrunk inside the intermediate larger-diameter tube 8, and the tube 8 can be shrunk inside the largest-diameter tube 6 so that the shrunk frame has only a third length of the whole tubular frame extended out as shown in FIG. 2.

The fixing unit 3 has a projecting plate 11, as shown in FIG. 4, fixed on an outer surface of an inner end of the tube 6, a threaded hole 12 provided in the plate 11, a tapered hole 13 in a left end of the intermediate tube 8 corresponding to the threaded hole 12, a steel bead 31 to fit nearly half in the tapered hole 13 urged by a coil spring 32 pushed by an adjusting bolt 33 engaging the threaded hole 12 and urging one end of the coil spring 32. After the tubes 8 and 7 are pulled to extend out fully, the two fixing units 3, 3 lock the three tubes 6, 7, 8, securely in an extended position with a proper tightness.

The winding unit 4 is mounted in a chamber 14 provided in the outer end of the tube 6, having a worm gear 42, a worm 41 meshing with the worm gear 42, a shaft 43 of a motor 5, a gear shaft 44 of the worm gear 42 and a rope 45 wound on the worm gear 42 and extending through the three tubes to be bound at the outer end of the tube 7. The motor 5 can be substituted by a handle (not shown in the Figures) connected with the worm 42 so as to manually winding the rope in shrinking the tubes 9 and 8 in the tube 6 instead of using electricity to rotate the motor 5.

Figure 3:
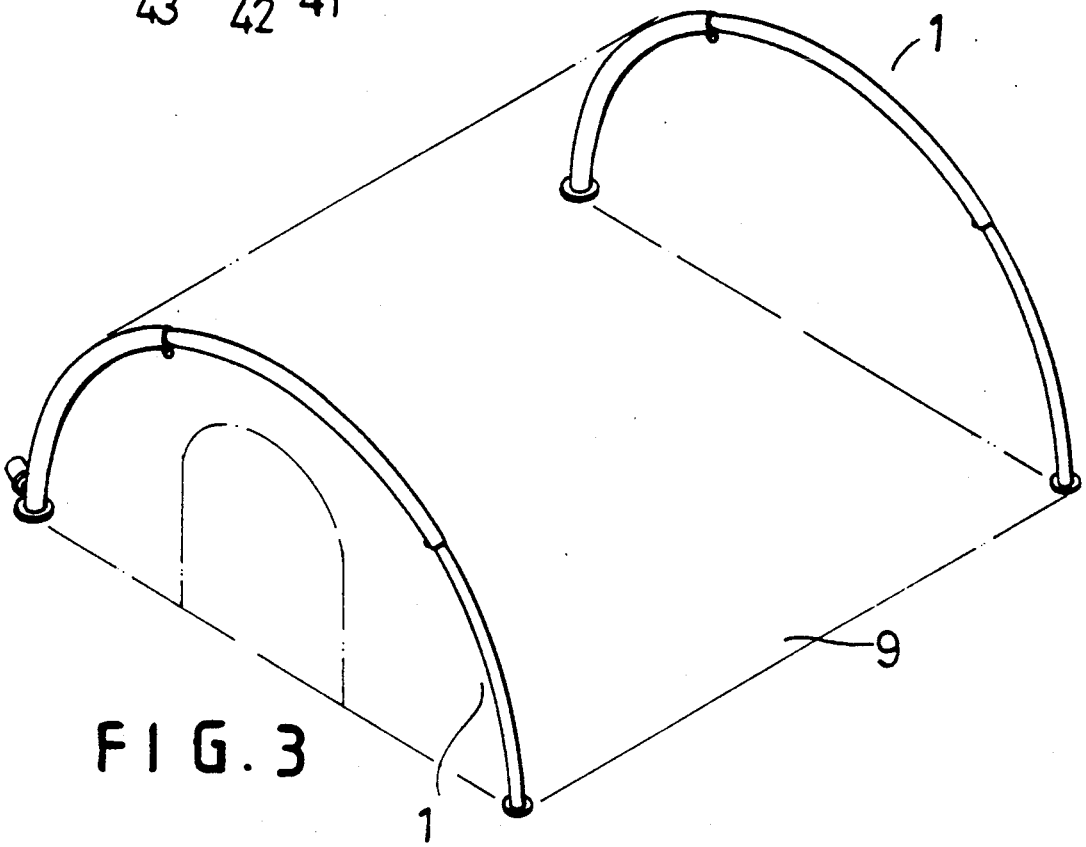
FIG. 3 is a perspective view of two shrinkable tubular frames utilized for a tent frame in the present invention; and, FIG. 4 is a magnified view of a fixing unit in the shrinkable tubular frame in the present invention.

This shrinkable tubular frame is applicable to a tent, a sunshade, etc. as shown in FIG. 3. First, the left end of the tube 6 of the shrinkable tubular frame is to be secured on the ground, then the tube 7 is manually pulled out of the tube 9 and then the tube 9 out of the tube 6. Next, the two fixing units 3, 3 are manipulated to fix the three tubes 6, 7, 8 securely and finally the outer end of the tube 7 is secured on the ground. When a plurality of this shrinkable tubular frames are prepared on the ground in the extended position, a tent 9 can be extended to cover on them.

In collapsing the extended tubular frame, after the tent 9 is taken down, the outer end of the tube 7 is released from the ground. Then the two fixing units 3, 3 are loosened by screwing the bolts 33, 33, and the motor 5 is started to wind the rope 45 of the winding unit 4, pulling the tube 7 to shrink in the tube 8, then the tube 8 in the tube 6. Or the handle instead of the motor is used to perform the same work. And the long coil spring 2 has elasticity to assist shrinking action.

While the preferred embodiments of the invention have been described above, it will be recognized and understood that various modifications may be made therein and the appended claims are intended to cover all such modifications which may fall within the spirit and scope of the invention.

What is claimed is:

1. A shrinkable tubular frame comprising:

a plurality of hollow curved tubes including a left largest diameter curved tube having an outer end, at least one intermediate curved tube having an outer end, a right smallest diameter curved tube having an outer end, said tubes having nearly the same length and curvature but different diameter so as to be telescopically bitted one inside another;

a coil spring having opposite ends extending through in said frame having one end fixed at an outer end of a left largest-diameter curved tube and the other end fixed at an outer end of a right smallest-diameter curved tube;

a plurality of fixing units for securing each two adjacent tubes when each said two adjacent tubes are extended out; and, a winding unit including a worm gear, a rope, a rope, a motor; wherein, said rope having one end connected to said outer end of said right smallest diameter curved tube and extending through all tubes, and the other end wound on said worm;

said motor connected to and rotating said worm such that said worm meshes with said worm gear and winds said rope on said worm to telescopically withdraw said tubes one inside another.

2. The shrinkable tubular frame claimed in claim 1, wherein said left largest diameter curved tube having an inner end, said inner end having an outer surface, said fixing unit having a projecting plate fixed on an outer surface of an inner end of said left largest-diameter curved tube and an outer surface of an end of said intermediate curved tube, said projecting plate having a threaded hole for an adjusting bolt to engage with a tapered hole provided in said intermediate curved tube and in said right smallest-diameter curved tube corresponding to said threaded hole for a steel bead to fit half therein, a coil spring provided in said threaded hole and pushed by a bottom end of said andjusting bolt to urge said steel bead, said adjusting bolt screwed to force said steel bead move in said tapered hole in said intermediate curved tube or in said right curved tube so that two said adjacent curved tubes can be kept secured with a proper tightness in an extended position or to release said steel bead to move out of said tapered hole so that said smallest-diameter right curved tube telescopically fitted in said intermediate larger-diameter curved tube, and said intermediate tube telescopically fitted in said left largest diameter tube in collapsing said frame.

3. The shrinkable tubular frame as claimed in claim 1, wherein said winding unit is provided with a handle instead of said motor for manually rotating said worm in winding said rope for shrinking said frame.

* * * * *

UNITED STATES PATENT AND TRADEMARK OFFICE

CERTIFICATE OF CORRECTION

PATENT NO. : 5,253,667

DATED : 19 October 1993

INVENTOR(S) : CHING-PAO CHUANG

It is certified that error appears in the above-indentified patent and that said Letters Patent is hereby corrected as shown below:

On the title page, under item [19] and item [76], change "Chung" to --Chuang--

Signed and Sealed this

Nineteenth Day of April, 1994

Bruce Lehman

*Attest:*

BRUCE LEHMAN

*Attesting Officer*

*Commissioner of Patents and Trademarks*